United States Patent [19]

Bianco

[11] 4,080,908

[45] Mar. 28, 1978

[54] SHUTTER ASSEMBLY FOR SLOT OR APERTURE

[76] Inventor: Eric L. Bianco, 120 E. Price St., Linden, N.J. 07036

[21] Appl. No.: 766,074

[22] Filed: Feb. 7, 1977

[51] Int. Cl.[2] ..... E05G 1/026

[52] U.S. Cl. ..... 109/66

[58] Field of Search ..... 109/55, 58, 59, 64, 109/66

[56] References Cited

U.S. PATENT DOCUMENTS

| | | | |
|---|---|---|---|
| 425,508 | 4/1890 | Harrison et al. | 109/66 |
| 1,607,361 | 11/1926 | Poland et al. | 109/66 |
| 1,852,053 | 4/1932 | Jendrek | 109/55 |
| 3,433,185 | 3/1969 | Roberts | 109/55 |

*Primary Examiner*—Robert L. Wolfe
*Assistant Examiner*—David H. Corbin
*Attorney, Agent, or Firm*—Daniel H. Bobis

[57] ABSTRACT

A shutter assembly for a sized slot or aperture generally in the front wall or partition of a depository safe or other security box or enclosure has a closure member having at least one portion wider than the sized slot or aperture disposed for sliding movement in channels formed on opposite sides of said sized slot or aperture to move from a position normally maintaining the sized slot or aperture closed to a position where the sized slot is open and vice versa. The closure member has a cam follower and is movable from open to closed position and maintained in closed position by a cam assembly which includes, a cam lever, means extending through said wall or partition for operative association with an actuator such as a key or handle for moving the cam lever into and out of engagement with the cam follower on the closure member, the closure member being further operatively associated with a spring or the like resilient means which is slightly compressed on opening movement of the closure member so that the spring acts to minimize the initial torque requirements of the cam assembly for moving the closure member from the open to the closed position.

Preferably the cam assembly should include lock means which extends through the wall or partition of the depository safe or security box and can be operated by a key from the exterior thereof.

2 Claims, 7 Drawing Figures

SHUTTER ASSEMBLY FOR SLOT OR APERTURE

BACKGROUND OF THE INVENTION

The invention relates generally to a depository safe or the like type of security boxes with closure doors having combination type locks thereon which include slots or apertures generally on the face thereof for receiving money, jewelry and the like type of valuables for safe keeping in the depository safe box without the requirement of opening the closure or access door thereof. More particularly the present invention relates to a shutter assembly for normally maintaining said slot or aperture on said depository safe or security box closed and blocked from entry but adapted to be operated for opening the slot or aperture preferably by means of a lock and key operated actuator.

Although a number of shutter assemblies for slots or openings are known in the prior art as is shown in U.S. Pat. Nos. 2,967,015; 1,852,053, and 1,607,361, it has been found that such closure members are unduly complicated and have only limited usefulness as for those special applications for which they are constructed.

Some prior art devices require that a sizable force has to be imparted to the actuator, generally a key in order to open the slot, aperture or door for transfer of the valuables to be deposited in the depository safe or security box.

Further, certain shutter assemblies for the slots or apertures on said deposit or security boxes require certain geometric configurations or shapes to obtain that particular type of operation. Such shutters are very elaborate and require complex mechanisms which are expensive to make. Therefore, when such devices are utilized it is often difficult to provide the desired strength for the walls of the devices without the considerable expenditure required to machine these complicated structures from the very heavy materials desirable for such purposes.

It is thought fundamental that where slots or apertures are provided the closure assemblies therefor must of necessity be very strong to prevent unauthorized and unlawful access to the valuables or other materials deposited in the depository safe or security box. Further not only must they have strength but in addition they must be so constructed that the "fishing" of items from the depository safe or security box is prevented.

The present invention provides a simple shutter mechanism or closure assembly which is strong and durable in construction, normally disposed to maintain a slot or aperture for the safe deposit or security box closed, which can be safely secured with a lock adaptable and accessible by key means from the exterior of the depository safe or security box, and which shutter assembly is designed to provide a cam mechanism wherein the initial closing torque is so balanced that the forces required for moving the shutter assembly from its open to its closed position are substantially reduced.

SUMMARY OF THE INVENTION

Thus, the present invention covers a shutter assembly for the slot or aperture in the front wall or partition of a depository safe or the like security device wherein, the wall or partition has a front face and a rear face, and the slot or aperture extends therethrough, support means defining channels are fixedly connected on the rear face of the partition on opposite sides of the slot or aperture, closure means is slidably disposed in the channels formed by the support means, said closure means is operatively associated with actuating means for maintaining said closure means in a position for closing said slot or aperture, said actuating means being disposed to extend through the partition to permit an actuator to engage said actuating means at the front wall of the partition for operating the closure member, and means are operatively associated with the actuating means to effectively reduce the torque requirements for moving said closure means from open to the normally closed position.

Accordingly it is an object of the present invention to provide a shutter assembly adapted for closing the slot or aperture in a depository safe or the like security box.

It is another object of the present invention to provide a shutter assembly which includes a lock and key actuating mechanism which is operable from the exterior of the depository safe.

It is another object of the present invention to provide a shutter assembly having means for reducing the initial torque requirements thereof for moving the shutter assembly from the open to the closed position.

The above and other significant objects and advantages of the present invention will be made clear in the following detailed description of a preferred form thereof when taken in conjunction with the accompanying drawings wherein.

Figure 1:
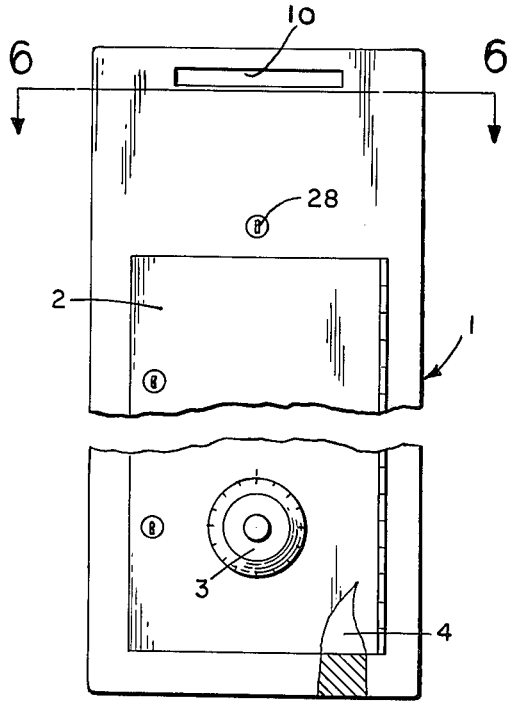
FIG. 1 is a front view of a conventional depository safe showing a sized slot or aperture in the upper section thereof.

Referring to the drawings in FIG. 1, a depository safe generally designated 1 is shown having a sized slot or aperture as at 10 in the upper section thereof.

Generally depository safes of this type will have an access door 2 with a combination lock 3 therein. The slot 10 will be used for depositing valuables into the safe deposit box when the access door is closed.

Safe deposit boxes with slotted openings of this type are well known and easily purchaseable on the open market and accordingly those skilled in the art will recognize that the safe deposit box is generally an elongated rectangular box-like member which defines a security chamber therein generally designated 4 which may be reached when the access door is opened by means of the combination lock.

In conventional depository safes when the access door 2 is closed thefts nonetheless have occurred through the "fishing" of items out of the security space 4 through the sized slot or aperture 10.

In order to prevent access in any manner by unauthorized persons the present invention provides a shutter assembly normally disposed to maintain the sized slot or aperture 10 closed and operable through a lock actuated cam mechanism to open and to release the slot as will now be described.

SHUTTER ASSEMBLY

Accordingly referring to FIGS. 2 to 7 of the drawings, the sized slot or aperture 10 is shown as extending through the front wall 6 of the depository safe 1. The front wall 6 has a front face 7 and a rear face 8 and the opening and closing of the sized slot or opening 10 is controlled by a relatively heavy closure member or closure plate generally designated 11 which is slidably mounted as hereinafter more fully described so as to move against against the rear face 8 of the front wall 6 in an upward direction to close the sized slot or aperture 10 and downwardly to open the same so that valuables can be passed through the slotted opening into the security area of the depository safe when the access door 2 is closed.

Figure 6:
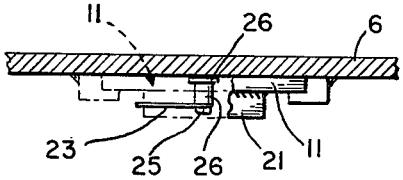
FIG. 6 is a horizontal section taken on line 6 to 6 of FIG. 1, partly broken away to show the cam member.
Figure 4:
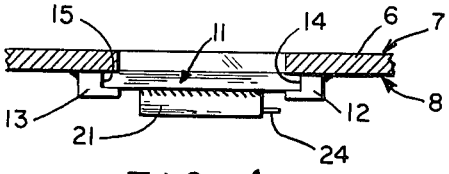
FIG. 4 is a horizontal section taken on line 4—4 of FIG. 2.
Figure 5:
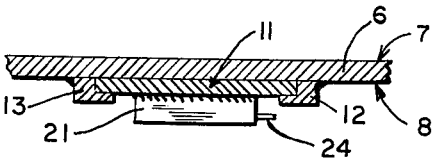
FIG. 5 is a horizontal section taken on line 5—5 of FIG. 2.

Suitably formed support members 12 and 13 which may be angled or L-shaped in cross-section as shown in FIGS. 5 and 6 are formed, welded or otherwise affixed in spaced relation on opposite sides of the sized slot or aperture 10 so as to define with the rear face 8 of the front wall 6 of the safe deposit box 1 spaced channels as at 14 and 15 so that if the closure member or closure plate 11 is properly sized it can be slidably disposed between the channels so as to move upwardly and downwardly in the longitudinal line of the safe deposit box 1 as above described. It will be clear to those skilled in the art that in this arrangement the closure member 11 would have a width greater than the width of the slot over its entire length and this provides strength and stability to the shutter assembly.

It will be understood by those skilled in the art that the closure member or closure plate 11 and the supporting members 12 and 13 must be made from materials which are at least as strong as the materials that are used in the walls of the safe in order to be capable of withstanding any attempts to gain forceable access to the security area 4 in the safe deposit box.

The length of the supporting members 12 and 13 will be such as to at all times support and back-up the closure member or closure plate 11 in all positions to which the closure plate may be moved.

In order to maintain the closure plate 11 in its normally closed position and to move the same to open position and to return it to the closed position, a suitable actuating means generally designated 20 will be provided which actuating means will be accessible from the exterior of the depository safe so that the closure member can be moved from its closed position to open position when it is desired to deposit valuables into the security area or chamber 4 in the depository safe 1 and then to again move the closure member to its normally closed position so that it can again act to prevent access to the valuables in the depository safe by fishing through the slot or aperture 10.

One form of actuating means as shown in the present invention includes, a cam follower 21 which is connected as by welding or other suitable means to the lower section of the closure member or closure plate 11. The cam follower 21 will be sufficiently strong to withstand any forceable tampering exerted against the closure member or closure plate 11 and will be sufficiently wide to present on the under side thereof a camming surface 22 against which a cam member 23 will be able to act to move the cam follower 21 and closure member or closure plate 11 to the closed position.

Cam member 23 is an elongated member which is rounded at the end 24 which engages the cam surface 22 on the cam follower 21 and at the end remote thereof is pivotally connected to a shaft member 25 which forms part of a lock 26 disposed in a bore 27 in the front wall 6 of the depository safe 1 so that the exterior face of the lock 27 lies flush with the outside or front face 7 of the front wall 6 leaving only the key hole 28 visable for access by a suitable key not shown.

Figure 2:
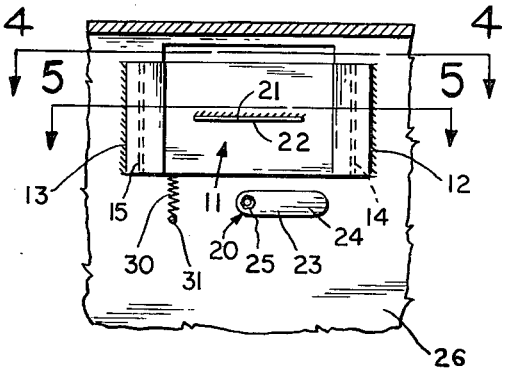
FIG. 2 is a fragmentary rear view of the sized slot or aperture portion of the depository safe shown in FIG. 1 showing the shutter assembly for the sized slot or aperture thereon in accordance with the present invention disposed in the position for maintaining the sized slot or aperture open.
Figure 3:
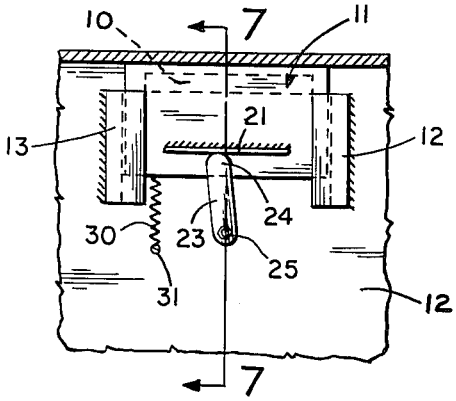
FIG. 3 is a fragmentary rear view of the section of the depository safe shown in FIG. 1 having the sized slot or aperture therein and showing the shutter assembly in the closed position.
Figure 7:
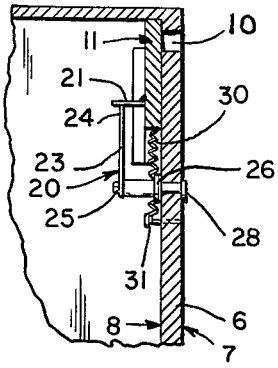
FIG. 7 is a vertical section taken on line 7—7 of FIG. 3.

When the key is inserted into the key hole it will act to release the lock and by turning the key the cam member 23 can be rotated through approximately 90° from a vertical position as shown in FIG. 3 to a horizontal position as shown in FIG. 2 to permit the cam follower 21 and closure member or closure plate 11 to move by action of gravity from closed to open position when it is desired to utilize the slot to deposit valuables into the security area 4 of the depository safe 1 at those times when the access door 2 is closed.

As indicated above the closure member or closure plate 11, the cam follower 21 and the cam member 23 must be sufficiently strong to withstand forceable tampering by unauthorized persons in their efforts to gain access to the security chamber of the depository safe through the slot or aperture 10.

In order to provide this strength these parts will be made of heavy materials and therefore will have considerable weight so that a relatively small key may be inadequate to provide the necessary force for the required turning action to operate the cam member 23 for actuating the closure member or closure plate from opened to closed position.

It will be obvious therefor to those skilled in the art that the operation is not in respect of moving the closure member or closure plate 11 to the open position because this occurs by force of gravity when the cam member 23 is rotated away from the under surface 22 of the cam follower 21. It is however in the movement of the closure member or closure plate 11 and the cam follower 21 from the open position to the closed position that the weight of these elements have bearing on the relative force that can be exerted by the key actuated lock 26 on the cam member 23 because the product of torque applied to the key and the angle covered by the rotation of the key has to be equal to the weight of the closure member 11 and cam follower 21 times the height that these elements have to move before the closure member 11 is again in position to maintain the slot or aperture 10 closed, plus, of course the frictional forces in the channels 14 and 15 that have to be overcome.

In the present invention this is accomplished in part by sizing the cam member and cam follower so as to spread the torque action of the cam member over a larger angle and thus minimize the force that will have to be applied to the key 29 to rotate the lock and the cam member 23 fixedly connected thereto through the necessary angle for moving the closure member or closure plate 11 and cam follower 21 into the closed position.

Additionally however means are further provided to reduce the amount of force necessary to effect such rotation of the cam by providing a balancing force which effectively reduces the weight of the closure member or closure plate 11 and the cam follower 21 so as to overcome the inertial forces acting on these elements during their initial movement from the open or rest position to the closed position.

This is accomplished by a suitable resilient means such as the helical spring 30 which is attached by threaded means 31 at a point adjacent the closure member or closure plate 11 at a spaced distance therefrom which will permit the closure member or closure plate 11 to begin engagement with the helical spring when the closure member 11 is about to clear the slot or aperture 10 so that it is fully open.

When this occurs if the spring is properly sized in accordance with the weight of the closure member 11 and cam follower 21 this will progressively compress the helical spring until in the fully open position the weight of these elements will be balanced or in equilibrium and thus it will take only a very small force to move these elements either upwardly out of this balanced or equilibrium position.

Thus when the cam member 23 is rotated from the horizontal position as shown in FIG. 6 it will require initially only a very small force to move the closure member and cam follower upwards due to the parallel forces exerted by the helical spring 30 as it is decompressed.

However, because the force or torque required on the key decrease as the closure member 11 moves upwardly the operation of the actuating means is facilitated and the actuating thereof can be accomplished by the relatively small key and lock arrangement. The reason for this is that while the frictional engagement of the rounded end 24 of the cam member 23 along the cam surface 22 of the cam follower 21 increases; the height that the closure member 11 and cam follower 21 must move decreases for a given angle of rotation for the key.

Thus, where the frictional forces are not large the combination of the spring 30 and the actuating means 20 is adequate to permit operation thereof by the rotary motion of the relatively small key.

While the helical resilient means for operative association with the cam member of the actuating means 20 has been illustrated, it will be understood that other means which counter balance the inertial forces when the closure member and cam follower elements are being moved to the closed position may be utilized without departing from the scope of the present invention.

It will be clear from FIG. 2 that when the closure member or closure plate 11 are in the closed position that the cam member 23 will be vertically disposed and that it will be impossible to force the closure member down because it is not possible to transfer rotational motion to the cam member 23 in this position.

It will be understood that the invention is not to be limited to the specific construction or arrangement of parts shown but that they may be widely modified within the invention defined by the claims.

What is claimed is:

1. In a shutter assembly for a sized opening through a partition having a front face and a rear face;

a. support members on the rear face of the partition in spaced relation to each other and disposed on opposite sides of the sized opening to define with the partition spaced channels, b. closure means mounted between said support members and slidably disposed for movement in said channels towards and away from the sized opening, c. actuating means mounted on said partition for moving said closure means and for normally maintaining said closure means so as to close said sized opening, and operative to permit the closure means to open said sized opening, d. said actuating means including, 1. cam follower means connected to the closure means, 2. a cam means disposed for movement into and out of engagement with the cam follower means for moving the closure means from open to closed position and for maintaining the closure means in the closed position, and 3. a detachable actuator connectable to said actuating means for moving the cam means to permit the closure means to move by gravity to open position and for operating the cam means to move said closure means to the closed position, and e. means operatively associated with said actuating means to overcome the inertial forces acting on said closure means to assist in movement of said closure means to the normally closed position.

2. In a shutter assembly as claimed in claim 1 wherein the means to assist in movement of said closure means to the normally closed position includes, a. resilient means disposed for operative engagement by the closure member during movement thereof to the open position, b. said resilient means sized to permit compression thereof for equalizing the weight of the closure means when the closure means has just moved to a position to fully open the sized slot or aperture in said partition.

* * * * *